US005645006A

United States Patent [19]

Moody

[11] Patent Number: 5,645,006

[45] Date of Patent: Jul. 8, 1997

[54] BLADDER ASSEMBLY FOR RETAINING FLUID UNDER PRESSURE

[75] Inventor: Paul E. Moody, Barrington, R.I.

[73] Assignee: The United States of America as represented by the Secretary of the Navy, Washington, D.C.

[21] Appl. No.: 587,412

[22] Filed: Jan. 17, 1996

[51] Int. Cl.[6] ..... B63G 8/32

[52] U.S. Cl. ..... 114/238; 114/319; 89/1.809; 124/71

[58] Field of Search ..... 42/1.14; 89/1.809, 89/1.81; 114/238, 316, 318, 319, 20.1; 124/71–73

[56] References Cited

U.S. PATENT DOCUMENTS

| | | | |
|---|---|---|---|
| 3,180,222 | 4/1965 | Moy | 89/1.81 |
| 3,327,586 | 6/1967 | Meade | 89/1.81 |
| 4,523,538 | 6/1985 | Hollmann et al. | 114/238 |
| 4,848,210 | 7/1989 | Bissonnette | 89/1.81 |
| 5,200,572 | 4/1993 | Bissonnette et al. | 89/1.81 |
| 5,231,241 | 7/1993 | Bissonnette | 89/1.81 |
| 5,410,978 | 5/1995 | Waclawik et al. | 114/238 |
| 5,438,948 | 8/1995 | Moody | 114/319 |

FOREIGN PATENT DOCUMENTS

| | | | |
|---|---|---|---|
| 2129106 | 5/1984 | United Kingdom | 89/1.809 |
| 2134232 | 8/1984 | United Kingdom | 89/1.809 |

*Primary Examiner*—Michael J. Carone
*Assistant Examiner*—Matthew J. Lattig
*Attorney, Agent, or Firm*—Michael J. McGowan; James M. Kasischke; Prithvi C. Lall

[57] ABSTRACT

A bladder assembly for retaining and discharging a fluid under pressure includes a first expandable elastomeric bladder member having a first annularly-shaped base end for anchoring to a foundation and defining a first fixed end, and a first dome-shaped wall portion upstanding from the first fixed end and defining a first movable end. The assembly further includes a second expandable elastomeric bladder member disposed within and contiguous to the first bladder member, and having a second annularly-shaped base end for anchoring to the foundation and defining a second fixed end, and a second dome-shaped wall portion upstanding from the second fixed end and defining a second movable end. The first and second bladder members and the foundation are joined by fixing the first and second base ends to the foundation.

13 Claims, 4 Drawing Sheets

BLADDER ASSEMBLY FOR RETAINING FLUID UNDER PRESSURE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The invention relates to submarine launch systems for torpedoes, and the like, and is directed more particularly to a bladder assembly for retaining and discharging water under pressure.

(2) Description of the Prior Art

Launch systems utilizing elastomeric bladders or diaphragms are known. Such systems provide advantages of low cost, minimal moving hardware parts, and minimal signature, or noise, associated with a launch.

Two types of elastomeric members have been proposed. A first type constitutes a generally spherical bladder. Sea water is pumped into the bladder, causing the bladder to expand. When the pressurized sea water is ported to the aft end of a launch tube, the elastomeric bladder forces the water to eject a torpedo, or other body, out of the launch tube as the bladder returns to its unstretched configuration. The launch is effected by use of only one moving mechanical component in the system, namely a firing valve which ports the pressurized sea water to the launch tube aft end.

A second type of elastomeric member constitutes a diaphragm which in an unextended state is essentially planar in configuration. The diaphragm is distended by pumping sea water on one side thereof. When the pressurized sea water is ported to the launch tube, the diaphragm forces water to eject the torpedo., or the like, out of the launch tube.

The first type of elastomeric member is disclosed in U.S. Pat. No. 4,848,210, issued Jul. 18, 1989, in the name of Laurent C. Bissonnette, wherein an elastomeric bladder of generally spherical configuration is shown in a projectile launch system. In U.S. Pat. No. 5,200,572, issued Apr. 6, 1993, in the name of Laurent C. Bissonnette, et al, there is disclosed a variation in which the bladder is generally ellipsoidal in configuration. The second type of elastomeric member is disclosed in U.S. Pat. No. 5,231,241, issued Jul. 27, 1993, in the name of Laurent C. Bissonnette, wherein an elastomeric diaphragm is shown in a projectile launch system.

The spherical and ellipsoidal bladders are expensive to manufacture and require a relatively large volume of space, always at a premium in submarine vessels. The diaphragm may be manufactured relatively inexpensively and e ires substantially less space than the spherical bladder. However, the connection of the periphery of the diaphragm to a foundation places bending stresses on the diaphragm and on the foundation. It is difficult to predict how many cycles of operation a diaphragm can safely withstand.

It is, therefore, desirable to have available an elastomeric member requiring less space than the spherical or ellipsoidal bladder, and having a safe and secure means by which the member is fixed to its foundation.

SUMMARY OF THE INVENTION

Accordingly, an object of the invention is to provide in an elastomeric launch system, an elastomeric member which requires less space than a spherical or ellipsoidal member, and which is adapted for safe and secure attachment to a foundation.

With the above and other objects in view, as will hereinafter appear, a feature of the present invention is the provision of a bladder assembly for retaining and discharging water under pressure to force a body from a launch tube. The assembly includes a first expandable elastomeric bladder member having a first annularly-shaped base end for anchoring to a foundation and defining a first open fixed end. A first dome-shaped wall portion upstands from the first fixed end and defines a first closed movable end. A second expandable elastomeric bladder member is disposed within, and is contiguous to, the first bladder member, and has a second annularly-shaped base end for anchoring to the foundation and defining a second open fixed end and a second dome-shaped wall portion upstanding from the second fixed end and defining a second movable end. The first and second bladder members and the foundation are provided with means for fixing the first and second bladder base ends to the foundation.

In preferred embodiments, a hypothetical extension of the curvature of the closed end of the dome-shaped first bladder member, in a non-expanded state, defines an arc which intersects a plane defined by the fixed end of the first member, the distance from the center of the first bladder member fixed end to the intersection substantially exceeding the distance from the center of the fixed end to the apex of the arc, and substantially exceeding the distance from the center of the fixed end to an outboard side of the first bladder member in the aforesaid plane such that the bladder is of less height, or "flatter" than a spherical or ellipsoidal bladder.

In a preferred embodiment, the means for fixing the bladder base ends to the foundation includes rigid rings embedded in the first and second bladder members proximate the first and second base ends, the base ends being provided with holes aligned with threaded holes in the rings, and rigid flange portions of the foundation having holes therein aligned with the base end holes and adapted to receive fasteners for engagement with the rings for the fixing of the base ends to the foundation.

In an alternative preferred embodiment, the means for fixing the bladder base ends to the foundation includes the first and second bladder base ends together being provided with a radial cross section configuration which is largest at the base ends and tapers therefrom to a smaller cross section removed from the base ends, and the foundation being provided with an annular groove configured complementarily to the bladder base ends together, to retain the first and second bladders in the groove.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
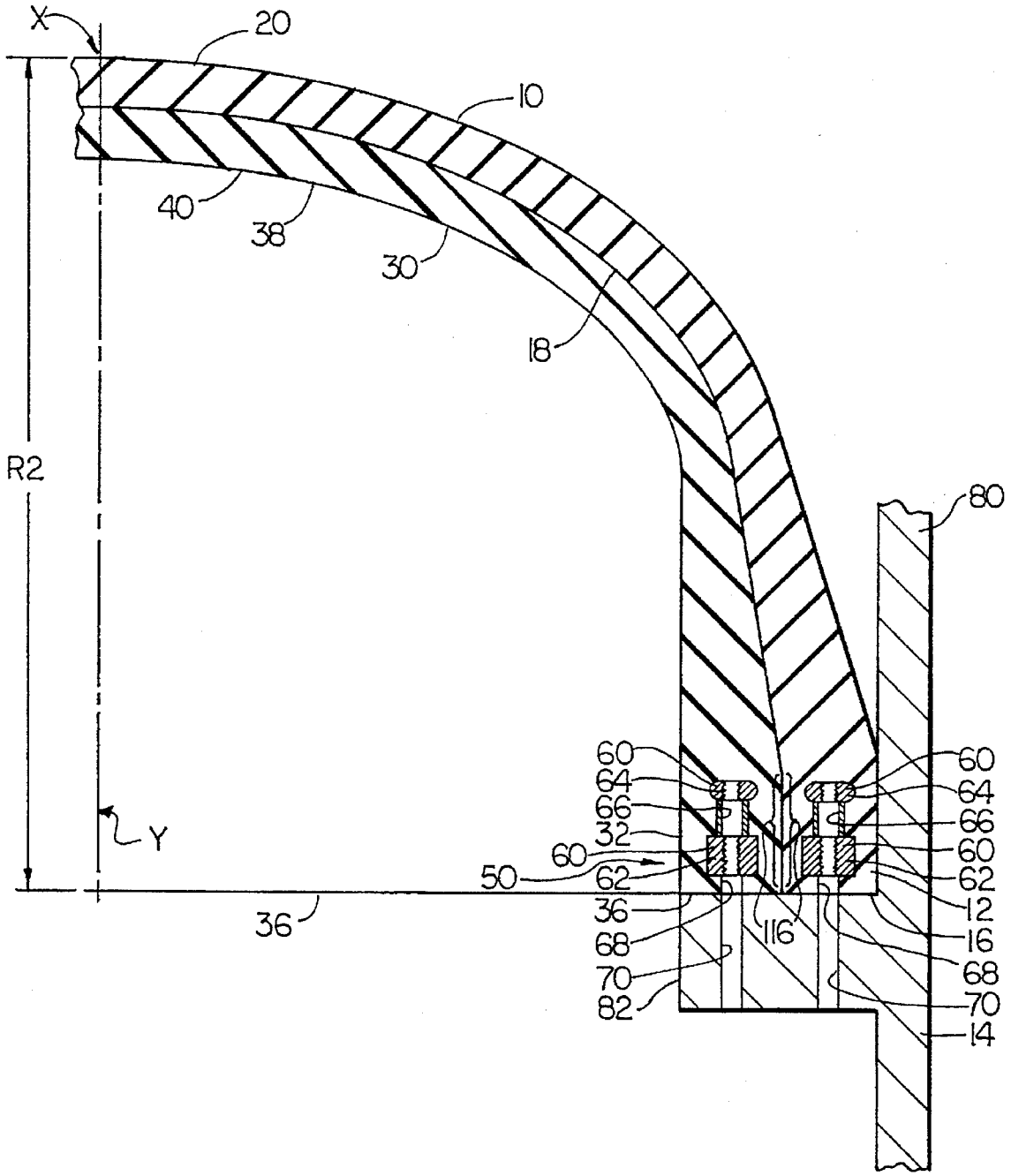
FIG. 1 is a centerline sectional view of a portion of an illustrative bladder member and one form of anchoring means therefor illustrative of an embodiment of the invention.

Referring to FIG. 1, it will be seen that the illustrative assembly includes a first expandable elastomeric member 10 having a first annularly-shaped base end 12 anchored to a foundation 14. The first base end 12 defines a first fixed end 16. The first elastomeric member 10 further is provided with a first dome-shaped wall portion 18 upstanding from the first fixed end 16 and defining a first movable end 20.

The assembly further includes a second expendable elastomeric bladder member 30 disposed within and contiguous to the first bladder member 10. The second bladder member 30 is provided with a second annularly-shaped base end 32 for anchoring to the foundation 14, and defines a second fixed end 36. The second bladder member 30 further is provided with a second dome-shaped wall portion 38 upstanding from the second fixed end 36 and defining a second movable end 40.

Figure 2:
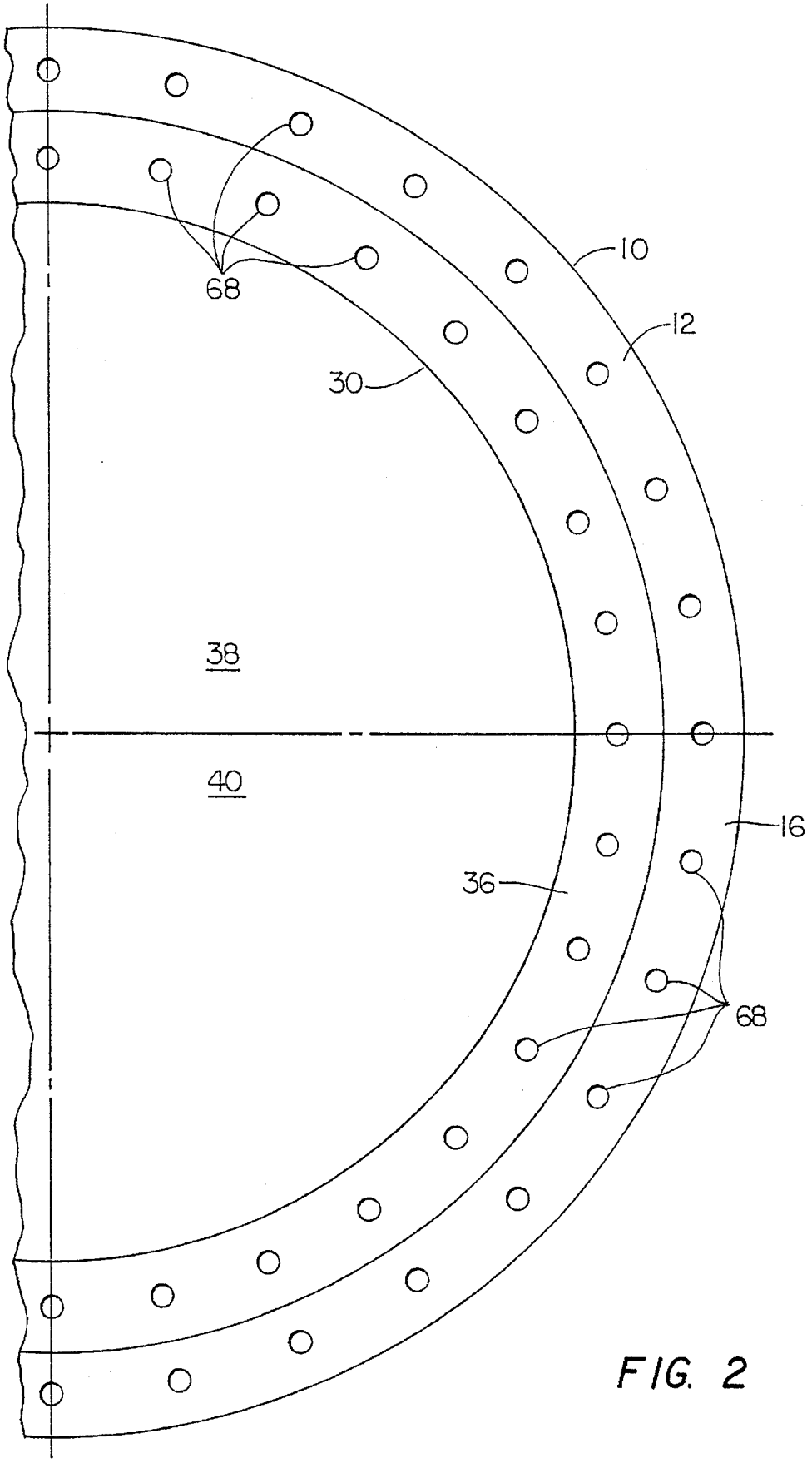
FIG. 2 is a bottom plan view of the bladder member portion shown in FIG. 1.

The first and second bladder members 10, 30 and the foundation 14 are provided with means 50 for fixing the first and second base ends 12, 32 to the foundation 14. Referring to FIGS. 1 and 2, it will be seen that a preferred embodiment of the means 50 for fixing the base ends 12, 32 of the bladder members 10, 30 to the foundation 14 include rigid rings 60 embedded in the first and second bladder members 10, 30 in the bladder member base ends 12, 32. In each of the bladder members 10, 30, the rigid rings 60 preferably are of metal and include for each bladder member a large ring 62 intermittently mechanically attached to a smaller ring 64 by a spacer 66. The large and small rings 62, 64 are provided with internal threads adapted to receive fasteners, such as bolts, inserted through holes 68 provided in the bladder ends 16, 36.

The means 50 for fixing the bladder members 10, 30 to the foundation 14 further comprises the provision of bores 70 in the foundation 14 aligned with the holes 68 for receiving the aforementioned fasteners for threaded engagement of the fasteners: with the rings 62, 64 to secure the bladder members 10, 30 to the foundation 14.

The foundation 14 comprises a rigid cylindrically shaped wall 80 having a rigid flange portion 82 extending inwardly therefrom. The bores 70 extend through the flange portion 82 to enable the aforementioned fasteners to anchor the bladder members 10, 30 within the confines of the wall 80.

Figure 3:
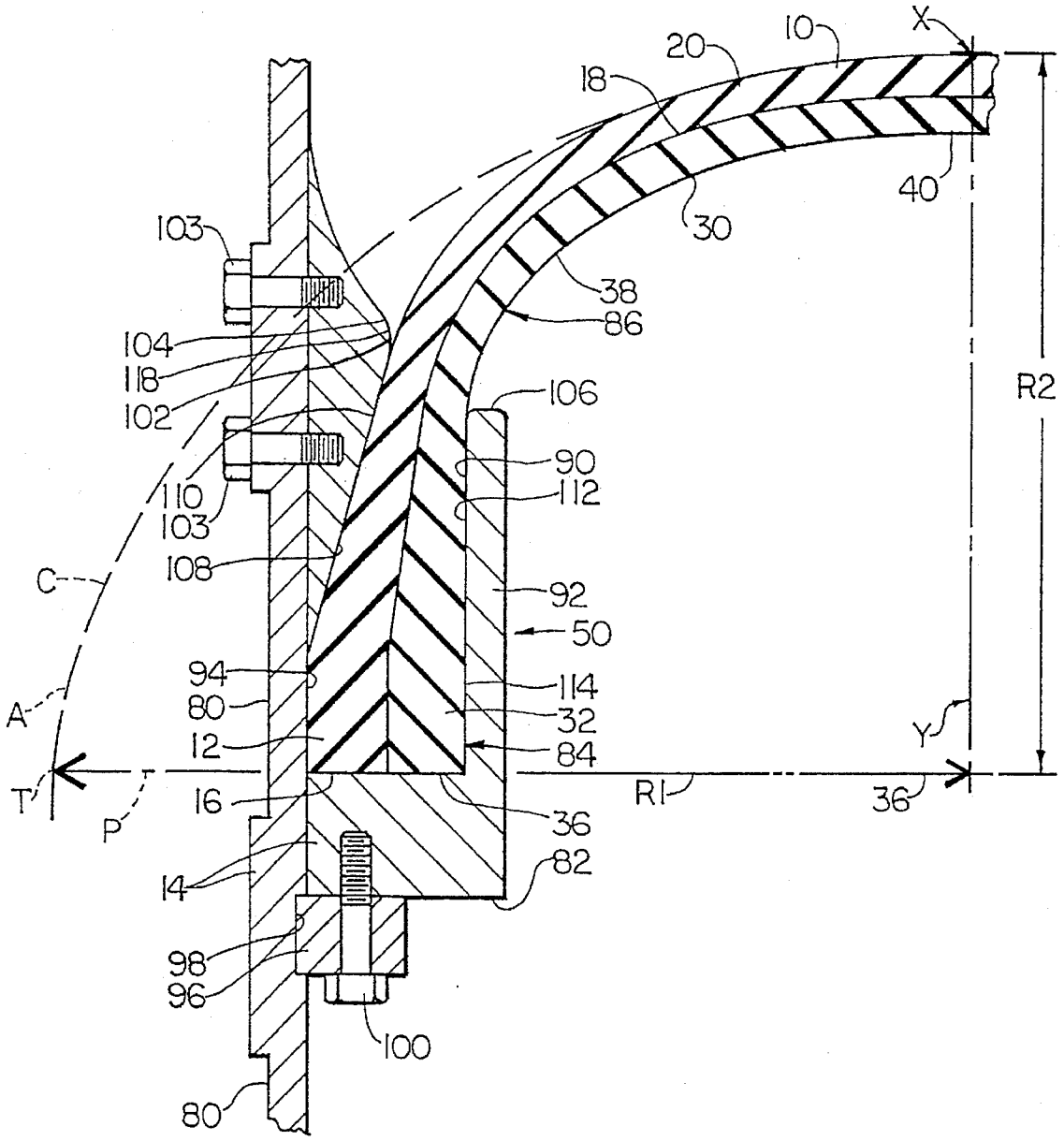
FIG. 3 is a centerline sectional view of a portion of an alternative bladder member and another form of anchoring means therefor, illustrative of an alternative embodiment of the invention.
Figure 4:
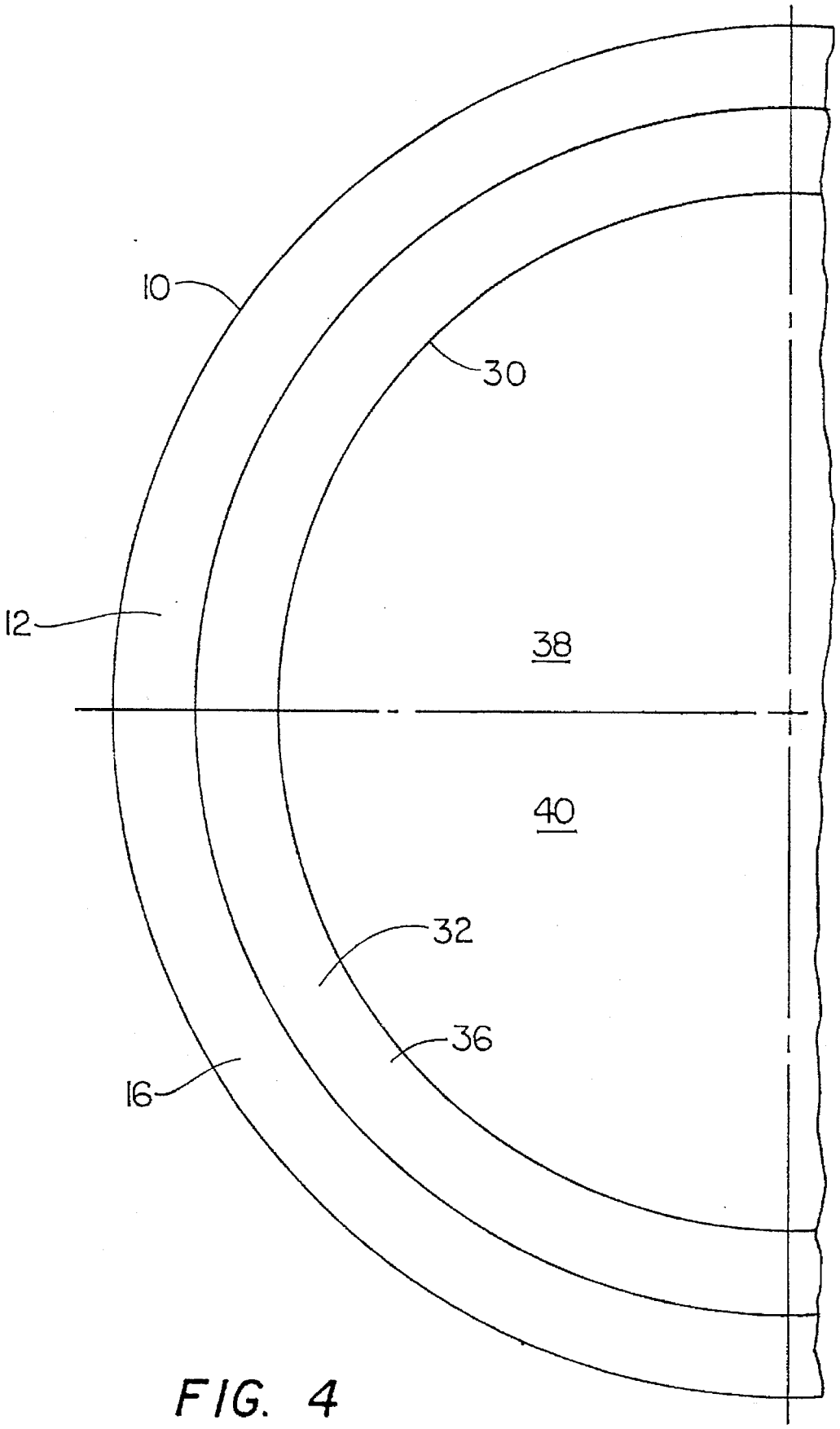
FIG. 4 is a bottom plan view of the bladder member portion shown in FIG. 3.

Referring to FIGS. 3 and 4, it will be seen that an alternative means 50 for fixing the bladder members 10, 30 to the foundation 14 comprises the provision of a radial cross section configuration 84 of the first and second bladder members 10, 30 together which is largest at the base ends 12, 32 and tapers therefrom to a smaller cross section 86 removed from the base ends.

In the embodiment shown in FIG. 3, the foundation 14 is provided with an annular groove 90 configured complementarily to the bladder base ends 12, 32 together, to retain the first and second bladders 10, 30 in the groove 90. The foundation comprises the rigid cylindrical wall 80, the flange portion 82 extending inwardly from the cylindrical wall 80, and a collar portion 92 upstanding from the flange portion 82 generally concentrically of the cylindrical wall 80. A base portion 94 of foundation 14 which supports groove 90 is defined by the cylindrical wall 80, the collar portion 92, and the flange portion 82.

The flange portion 82 may be integral with the cylindrical wall 80, or may be fixed to the wall 80 by an annular key 96 lodged in a groove 98 in the wall 80 and secured to the flange portion 82 by a fastener, such as a bolt 100, as shown in FIG. The fasteners for disposition in the bores 70 (FIG. 1) may also be bolts 100 of the type shown in FIG. 3.

The assembly illustrated in FIG. 3 further includes a retaining ring 102 extending inwardly from the cylindrical wall 80. An inward-most extent 104 of the retaining ring 102 is disposed proximate a free end 106 of the collar portion 92. An inboard surface 108 of the retaining ring 102 is complementary to an outboard surface 110 of the first bladder member 10, and an outboard surface 112 of the collar portion 92 is complementary to an inboard surface 114 of the second bladder member 30. The retaining ring 102 may be fastened on the wall as by bolts 103 shown in FIG. 3 to allow assembly and replacement of the bladders.

The first and second bladder members 10, 30 are bonded together by a sealant bonding material in areas 116 where the bladder members base ends 12, 32 abut each other, to insure that the bladder members 10, 30 act as a unit and that no fluid gets between the bladder members. The sealant areas 116 are shown in FIG. 1, but preferably are utilized also in the embodiment shown in FIG. 3.

The collar free end 106 and a ridge 118 defined by the inward-most extent 104 of the retaining ring 102 are rounded such that expansion of the bladder members 10, 30 does not press the bladder members against a sharp edge.

In FIG. 3, there is shown in phantom a diagrammatic extension C of the curvature of the first movable end 20 of the bladder member 10 in a non-expanded state. The hypothetical extension C defines an arc A which intersects at T a plane P defined by the first fixed end 16 of the first bladder member The distance R1 from the center Y of the first fixed end 16 to the intersection T substantially exceeds the distance R2 from the center Y of the first fixed end 16 to the apex X of the arc A. Further, the distance R1 substantially exceeds the distance from the center Y of the first fixed end 16 to an outboard side of the first bladder member 10 in the plane of the first fixed end 16. Thus, the first bladder member 10, as well as the second bladder member 30, which is contiguous to the first bladder member 10, are of a configuration substantially "flatter" than the spherical and ellipsoidal types of bladders.

While the description immediately above of the configuration of the dome-shaped bladder members is undertaken with reference to FIG. 3, it will be apparent that the description applies equally to the embodiment shown in FIG. 1.

There is thus provided a bladder assembly requiring less space than a spherical or ellipsoidal bladder, and in which bending stresses applied to the bladder and to the foundation at the juncture of the bladder and foundation are greatly reduced. In addition, there is provided a bladder having increased reliability. Because the failure of one bladder member does not result in the entire assembly becoming inoperable, the chances of launch failure are substantially reduced. Further, inasmuch as the thickness of either of the bladder members is substantially less than the thickness of the prior art single bladder, molding of the bladder members is less complex and less expensive.

It is to be understood that the present invention is by no means limited to the particular constructions herein disclosed and/or shown in the drawings, but also comprises any modifications or equivalents within the scope of the claims.

What is claimed is:

1. A bladder assembly for retaining and discharging a fluid under pressure, said assembly comprising:

a rigid foundation;

a first expandable elastomeric bladder member having a first annularly-shaped base end for anchoring to said foundation and defining a first fixed end, and a first dome-shaped wall portion upstanding from said first fixed end and defining a first movable end;

a second expandable elastomeric bladder member disposed within and contiguous to said first bladder member, said second bladder member having a second annularly-shaped base end for anchoring to said foundation and defining a second fixed end, and a second dome-shaped wall portion upstanding from said second fixed end and defining a second movable end; and said first and second bladder members and said foundation being provided with means for fixing said first and second base ends to said foundation.

2. The bladder assembly in accordance with claim 1 wherein a hypothetical extension of the curvature of said first closed end of said first bladder member in a non-expanded state defines an arc which intersects a plane defined by said first fixed end of said first bladder member, with the distance from the center of said first fixed end to said intersection substantially exceeding the distance from said center of said fixed end to the apex of said arc, and substantially exceeding the distance from the center of said first fixed end to an outboard side of said first bladder member in said plane.

3. The bladder assembly in accordance with claim 1 wherein said first and second bladder members are bonded together.

4. The bladder assembly in accordance with claim 3 wherein said bladder members are bonded together by a sealant.

5. The bladder assembly in accordance with claim 4 wherein said sealant is disposed between said bladder members at said base ends of said bladder members.

6. The bladder assembly in accordance with claim 1 wherein said means for fixing said base ends to said foundation comprises:

a radial cross section configuration of said first and second bladder members together which is largest at said base ends and tapers therefrom to a smaller cross section removed from said base ends; and said foundation is provided with an annular groove therein configured complementarily to said bladder base ends together, to retain said first and second bladders in said groove.

7. The bladder assembly in accordance with claim 6 wherein said foundation comprises:

a rigid cylindrical wall;

a flange portion extending inwardly from said rigid cylindrical wall; and a collar portion upstanding from said flange portion generally concentrically of said cylindrical wall, said groove being defined between said cylindrical wall and said collar portion.

8. The bladder assembly in accordance with claim 7 wherein said foundation further comprises a retaining ring extending inwardly from said cylindrical wall, an inwardmost extent of said retaining ring being disposed proximate a free end of said collar portion.

9. The bladder assembly in accordance with claim 8 wherein an inboard surface of said retaining ring is complementary to an outboard surface of said first bladder member and an outboard surface of said collar portion is complementary to an inboard surface of said second bladder member.

10. The bladder assembly in accordance with claim 1 wherein said means for fixing said base ends to said foundation comprises:

rigid rings embedded in said first and second bladder proximate said first and second base ends, said base ends being provided with holes aligned with threaded holes in said rings; and rigid flange portions joined to said foundation having holes therein aligned with said base end holes and adapted to receive fasteners for engagement with said rings for said fixing of said base ends to said foundation.

11. The bladder assembly in accordance with claim 10 wherein said rigid rings embedded in said first bladder member comprise first and second metal rings, and said rigid rings embedded in said second bladder member comprise third and fourth metal rings.

12. The bladder assembly in accordance with claim 10 wherein said foundation comprises a rigid cylindrical wall and said flange portions extending inwardly from said cylindrical wall.

13. The bladder assembly in accordance with claim 12 wherein said assembly further comprises said fasteners fixed to said rigid rings and disposed in said flange portion holes.

* * * * *